US010631706B2

(12) United States Patent
Bürkle et al.

(10) Patent No.: US 10,631,706 B2
(45) Date of Patent: Apr. 28, 2020

(54) RINSE ARM SYSTEM FOR WAREWASHER

(71) Applicants: Udo Bürkle, Hohberg (DE); Martin Stettinius, Friesenheim (DE)

(72) Inventors: Udo Bürkle, Hohberg (DE); Martin Stettinius, Friesenheim (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 366 days.

(21) Appl. No.: 15/518,678

(22) PCT Filed: Oct. 21, 2015

(86) PCT No.: PCT/US2015/056545
§ 371 (c)(1),
(2) Date: Apr. 12, 2017

(87) PCT Pub. No.: WO2016/069333
PCT Pub. Date: May 6, 2016

(65) Prior Publication Data

US 2017/0231461 A1 Aug. 17, 2017

(30) Foreign Application Priority Data

Oct. 27, 2014 (DE) ..... 20 2014 105 113

(51) Int. Cl.
*A47L 15/22* (2006.01)
*A47L 15/23* (2006.01)
(Continued)

(52) U.S. Cl.
CPC ..... *A47L 15/22* (2013.01); *A47L 15/23* (2013.01); *A47L 15/0078* (2013.01); *A47L 2501/20* (2013.01); *B05B 13/0278* (2013.01)

(58) Field of Classification Search
CPC ..... A47L 15/22; A47L 15/23; A47L 15/0081
See application file for complete search history.

(56) References Cited

U.S. PATENT DOCUMENTS 2,063,746 A 11/1936 Meeker
2,073,521 A 3/1937 Johnston et al.
(Continued)

FOREIGN PATENT DOCUMENTS

CN 102204804 10/2011
CN 203677025 7/2014
(Continued)

OTHER PUBLICATIONS

PCT, International Search Report and Written Opinion, International Application No. PCT/US2015/056545; dated May 11, 2017, 8 pages.
(Continued)

*Primary Examiner* — Michael E Barr
*Assistant Examiner* — Kevin G Lee
(74) *Attorney, Agent, or Firm* — Thompson Hine LLP

(57) ABSTRACT

A rinse arm system for a warewasher includes a rinse arm (1) rotatable about a rotation axis (D), a locking mechanism (2) connected to the rinse arm (1) such that the locking mechanism (2) is rotatable with respect to the rinse arm (1), and a bushing (3). The locking mechanism (2) is latched in an interlocking manner to the bushing (3) or clamped in a force-fitting manner to the bushing (3) such that the locking mechanism (2) is fixedly connected to the bushing (3) and the rinse arm (1) is rotatable about the rotation axis (D) with respect to the bushing (3).

13 Claims, 5 Drawing Sheets

(51) Int. Cl.
*A47L 15/00* (2006.01)
*B05B 13/02* (2006.01)

(56) References Cited

U.S. PATENT DOCUMENTS

| | | | | |
|---|---|---|---|---|
| 2,128,008 | A | 8/1938 | Meeker | |
| 2,158,904 | A | 5/1939 | Meeker et al. | |
| 2,217,705 | A | 10/1940 | Rataicsak et al. | |
| 2,229,663 | A | 1/1941 | Meeker et al. | |
| 2,380,059 | A * | 7/1945 | Meeker | A47L 15/23 239/244 |
| 2,637,595 | A | 5/1953 | Fox | |
| 2,707,961 | A | 5/1955 | Geiger et al. | |
| 2,947,311 | A | 8/1960 | Fox et al. | |
| 3,049,391 | A | 8/1962 | Meeker et al. | |
| 3,141,618 | A | 7/1964 | Haas | |
| 3,568,935 | A | 3/1971 | Hoffman | |
| 3,695,283 | A | 10/1972 | Ringwall | |
| 3,706,317 | A | 12/1972 | Fox et al. | |
| 3,918,644 | A | 11/1975 | Platt et al. | |
| 3,941,139 | A | 3/1976 | Spiegel | |
| 4,014,467 | A | 3/1977 | Ferguson | |
| 4,018,239 | A | 4/1977 | Caldwell et al. | |
| 4,107,990 | A | 8/1978 | Rngwall | |
| 4,157,161 | A | 6/1979 | Bauer | |
| 4,187,122 | A | 2/1980 | Query | |
| 4,210,285 | A | 7/1980 | Dicken et al. | |
| RE30,537 | E | 3/1981 | Fraula et al. | |
| 4,257,559 | A | 3/1981 | Noren | |
| 4,325,235 | A | 4/1982 | Bauer et al. | |
| 4,418,868 | A | 12/1983 | Gurubatham et al. | |
| 4,439,242 | A | 3/1984 | Hadden | |
| 4,463,904 | A | 8/1984 | Bray, Jr. | |
| 4,561,904 | A | 12/1985 | Eberhardt, Jr. | |
| 4,657,188 | A | 4/1987 | Crane et al. | |
| 4,869,428 | A | 9/1989 | Gombar | |
| 5,197,673 | A | 3/1993 | Sullivan | |
| 5,267,582 | A | 12/1993 | Purtilo | |
| 5,383,486 | A | 1/1995 | Warner et al. | |
| 5,464,482 | A | 11/1995 | Michael et al. | |
| 5,662,744 | A | 9/1997 | Tuller et al. | |
| 5,725,002 | A | 3/1998 | Payzant | |
| 5,906,317 | A | 5/1999 | Srinath | |
| 5,927,616 | A | 7/1999 | Grise et al. | |
| 5,967,418 | A | 10/1999 | MacDonald et al. | |
| 6,110,292 | A | 8/2000 | Jewett et al. | |
| 6,315,221 | B1 | 11/2001 | Goenka et al. | |
| 6,325,083 | B1 | 12/2001 | Worter | |
| 6,371,138 | B1 | 4/2002 | Kamoto et al. | |
| 6,467,476 | B1 | 10/2002 | Ivri et al. | |
| 6,550,607 | B1 | 4/2003 | Watson et al. | |
| 6,736,340 | B1 | 5/2004 | Wang | |
| 6,739,526 | B2 | 5/2004 | Wlodarczyk | |
| 6,964,090 | B2 | 11/2005 | Mathieu et al. | |
| 7,083,121 | B2 | 8/2006 | Huffman | |
| 7,314,188 | B2 | 1/2008 | Watson et al. | |
| 2006/0054204 | A1 * | 3/2006 | Fischer | A47L 15/22 134/176 |
| 2013/0206179 | A1 * | 8/2013 | Watson | A47L 15/428 134/25.2 |
| 2017/0340186 | A1 * | 11/2017 | Watson | A47L 15/428 |

FOREIGN PATENT DOCUMENTS

| | | |
|---|---|---|
| DE | 1503901 | 7/1969 |
| DE | 1920575 | 11/1970 |
| DE | 1957141 | 2/1971 |
| DE | 2534261 | 4/1976 |
| DE | 9209962 | 11/1993 |
| DE | 4230054 | 3/1994 |
| DE | 19544985 | 6/1996 |
| DE | 19812329 | 6/1999 |
| DE | 102008011743 | 9/2009 |
| DE | 102009057461 | 8/2011 |
| EP | 2556781 | 2/2013 |
| WO | WO 2013/122893 | 8/2013 |

OTHER PUBLICATIONS

PCT, International Search Report and Written Opinion, International Application No. PCT/US2015/056545; dated Aug. 2, 2016, 10 pages.

* cited by examiner

RINSE ARM SYSTEM FOR WAREWASHER

The present invention relates to a rinse arm system for a warewasher, in particular a commercial utensil washer or dishwasher.

Accordingly, the invention relates in particular to a rinse arm system for a warewasher which is in the form of a commercial utensil washer or dishwasher designed as a batch dishwasher and which is configured as a hood-type dishwasher, wherein the warewasher has a treatment chamber with at least one wash system designed as a recirculation system.

Batch dishwashers are warewashers which can be manually loaded and unloaded. Batch dishwashers (also called "box-type warewashers") may be hood-type dishwashers ("hood-type warewashers") or front-loader dishwashers ("front-loader warewashers"). Front-loader dishwashers may be under-counter machines, top-counter machines or free-standing front-loader dishwashers.

A dishwasher which is in the form of a batch dishwasher usually has a treatment chamber for cleaning washware. The treatment chamber generally has arranged beneath it a wash tank in which liquid from the treatment chamber can flow back due to the force of gravity. The wash tank contains wash liquid, which is usually water, to which detergent may be added if required.

A dishwasher which is designed as a batch dishwasher usually also has a wash system comprising a wash pump, a line system which is connected to the wash pump, and a large number of spray nozzles which are formed in at least one wash arm. The wash liquid contained in the wash tank can be conveyed from the wash pump to the wash nozzles via the line system and can be sprayed onto the washware to be cleaned through the wash nozzles in the treatment chamber. The wash arm rotates about an axis of rotation that runs through the fastening of the wash arm in the treatment chamber. The sprayed wash liquid then flows back into the wash tank.

The term "washware" used in the present document is intended to be understood to mean, in particular, crockery, glasses, cutlery, cooking utensils, baking utensils and serving trays.

Commercial dishwashers which are in the form of batch dishwashers normally operate in two main process steps: a first step which includes washing with a wash liquid, as has already been described, and a second step which includes final rinsing.

In the final rinsing, the washware in the treatment chamber is sprayed with preferably heated fresh water and/or with the metered addition of a final rinse aid. The fresh water and/or the final rinse aid is designated as rinse water and is conveyed through at least one rinse water line to a plurality of spray nozzles formed in at least one rinse arm. Final rinsing is carried out using fresh water, preferably using fresh water from a water heater (boiler). The fresh water is likewise collected by the wash tank of the dishwasher after being sprayed.

The main objective of final rinsing is to remove wash liquor from the washware. In addition, the final rinse water which flows into the wash tank during the final rinse step serves to regenerate the wash water which is present in the wash tank.

Before fresh water is sprayed as final rinse liquid as a result of final rinsing and thus conducted into the wash tank of the dishwasher, a quantity of wash liquid which is equal to the quantity of fresh water is pumped out of the wash tank.

The document WO 2013/122893 A1 discloses a rinse arm system in which a rinse arm, a locking mechanism and a wash arm are provided inside a treatment chamber of a warewasher.

In this conventional system already known, wash liquid is sprayed onto the washware via the wash arm, in a first step, and rinse liquid is sprayed onto the washware via the rinse arm in a second step. The locking mechanism is fixedly connected to the rinse arm, such that, when rinse liquid is sprayed from the rinse arm, the rinse arm is rotated together with the locking mechanism. The locking mechanism serves to ensure that the rinse arm can be removed more easily from the treatment chamber, i.e. without the use of a special tool. This serves, for example, for repair or maintenance purposes. In particular, this serves for cleaning purposes, in the sense that the rinse arm can be released by a user, without the need to use a separate tool, and can be easily cleaned. For this purpose, the locking mechanism has lateral slides that can be actuated in order to release the rinse arm.

The system described in the prior art has the disadvantages that the rinse arm and locking mechanism are subject to a high degree of wear, since the locking mechanism is rotated also during operation, and, what is more, wash liquid which is sprayed from the wash arm can be disturbed by the rinse arm and locking mechanism, in such a way that the jet of wash liquid can be deflected, for example, and the wetting of the washware with wash liquid is then not optimal.

Proceeding from this problem, it would be desirable to develop a rinse arm system of the type mentioned at the outset, in such a way that it reduces the wear of the components and at the same time improves the cleaning performance in the treatment chamber.

Thus, according to one example, a rinse arm system in particular is specified which has a rinse arm that can be rotated about a rotation axis in order to spray rinse liquid onto the washware to be cleaned. The rinse arm can be connected to a locking mechanism in such a way that the locking mechanism can be rotated about the rotation axis with respect to the rinse arm. The locking mechanism in turn can be brought into form-fit or force-fit engagement with a bushing, in such a way that the locking mechanism latches or clamps onto the bushing. In this way, the locking mechanism can be fixedly connected to the bushing, while the rinse arm can be rotated about the rotation axis with respect to the locking mechanism and with respect to the bushing.

The advantages of the invention are identifiable. While the locking mechanism in conventional systems is fixedly connected to the rinse arm, provision is made according to the invention that the locking mechanism can be rotated about the rotation axis with respect to the rinse arm, and the rinse arm can be rotated about the rotation axis with respect to the locking mechanism. This means that the locking mechanism is not moved during the operation of the rinse arm, i.e. when rinse liquid is sprayed on through the rinse arm. In particular, the locking mechanism is not rotated. In the already known system, such rotation of the locking mechanism generates a high degree of wear, which is generated in particular by possible entry of dirt particles into the rotating locking mechanism. Moreover, wetting of the locking mechanism with rinse liquid cannot entirely prevent such entry, such that the durability of the locking mechanism suffers. According to the invention, these disadvantages are overcome, since the locking mechanism is latched or clamped fixedly on the bushing and is not moved when the rinse arm is actuated.

According to one aspect of the invention, provision is made that the system has a wash arm which can be pushed over the bushing and can be fastened by a clamping ring to a housing, which is fastened above the wash arm, the locking mechanism and the rinse arm on the inside of a treatment chamber of the warewasher when the rinse arm system is located in the upper part of the interior of the warewasher. When the rinse arm system is located at the lower base of the treatment chamber of the warewasher, the housing is arranged below the rinse arm, the locking mechanism and the wash arm. The wash arm is provided to be rotatable with respect to the rotation axis.

The provision of a clamping ring for fastening the wash arm to the housing ensures that the wash arm can, if necessary, be easily separated from the housing by actuation of the clamping ring. Overall, on account of the locking mechanism, the rinse arm can be released from the bushing without the use of an additional tool and, by actuation of the clamping ring, the wash arm can be removed from the housing, such that the rinse arm and the wash arm can be separately cleaned, serviced or replaced.

According to a further aspect of the invention, provision is made that the locking mechanism is arranged between the wash arm and the rinse arm.

This ensures that the rinse arm, which is connected rotatably to the locking mechanism, can be latched or clamped onto the bushing after the wash arm has been removed from the housing by means of the clamping ring. In other words, this ensures that the rinse arm can be released from the bushing by actuation of the locking mechanism, without the wash arm having to be separated from the housing for this purpose.

According to a further aspect of the invention, provision is made that the rinse arm is rotatable with respect to the wash arm and with respect to the locking mechanism.

The rinse arm can thus be actuated, i.e. can spray rinse liquid, without the wash arm or the locking mechanism also being rotated in the process, which would lead to increased wear. Likewise, the wash arm can be actuated without the rinse arm or the locking mechanism being rotated also, which again would lead to increased wear of these components. In addition, the rotation of the wash arm can be chosen such that no wash liquid is diverted through the rinse arm and, consequently, the wetting of the washware with wash liquid can take place optimally.

According to a further aspect of the invention, provision is made that the locking mechanism can be latched or clamped onto the bushing and can be connected to the rinse arm in such a way that the locking mechanism can be removed from the bushing together with the rinse arm by operating slides which are arranged on the locking mechanism.

This ensures that no additional tool is needed to separate the locking mechanism and the rinse arm from the bushing. Such separation can be achieved by simple actuation, i.e. pressing together, of the slides which are arranged laterally on the locking mechanism. In this way, the engagement that was produced between the locking mechanism and the bushing will be released and the locking mechanism will be easily pulled off together with the rinse arm. The engagement between the locking mechanism and the bushing is provided, for example, by the locking mechanism latching with a form fit into a hexagonally shaped indentation of the bushing. It is also conceivable that the engagement is provided for a force-fit connection between the locking mechanism and the bushing. It is thus possible to dispense with an indentation in the bushing, and a connection is ensured by static friction between the locking mechanism and the bushing.

According to a further aspect of the invention, provision is made that at least one wash water line and/or rinse water line is provided in such a way that the wash arm is supplied with wash liquid and the rinse arm is supplied with rinse liquid.

This ensures that the wash arm can be actuated independently of the rinse arm, and the rinse arm can be actuated independently of the wash arm.

According to a further aspect of the invention, provision is made that the wash water line is arranged in the interior of the housing.

This ensures that the wash water line is not damaged by external factors, e.g. when fitting the treatment chamber of the warewasher. Accordingly, the wash water line is arranged in the interior of the housing, such that wash liquid can arrive safely at the wash arm.

According to a further aspect of the invention, provision is made that the rinse water line is arranged in the interior of the housing.

This prevents damage to the rinse water line, as described above with reference to the wash water line.

According to a further aspect of the invention, provision is made that a second bushing can be fixedly connected to the rinse arm, preferably with a force fit, and, in the connected state, partially projects from the rinse arm, such that the projecting portion can be connected to the locking mechanism and can be inserted preferably into the first bushing in such a way that the first bushing serves as a guide for the rinse arm.

This ensures that the rinse arm, in its horizontal direction of extent, is oriented parallel to the corresponding horizontal direction of extent of the wash arm.

Moreover, the second bushing is rotatable with respect to the rotation axis and rotatable with respect to the locking mechanism, as a result of which it is again ensured that, during the operation of the warewasher, the locking mechanism is not rotated and thus is not subjected to any appreciable wear.

The invention is described in greater detail below with reference to illustrative embodiments of the rinse arm system according to the invention that are shown in the attached drawings.

Figure 1:
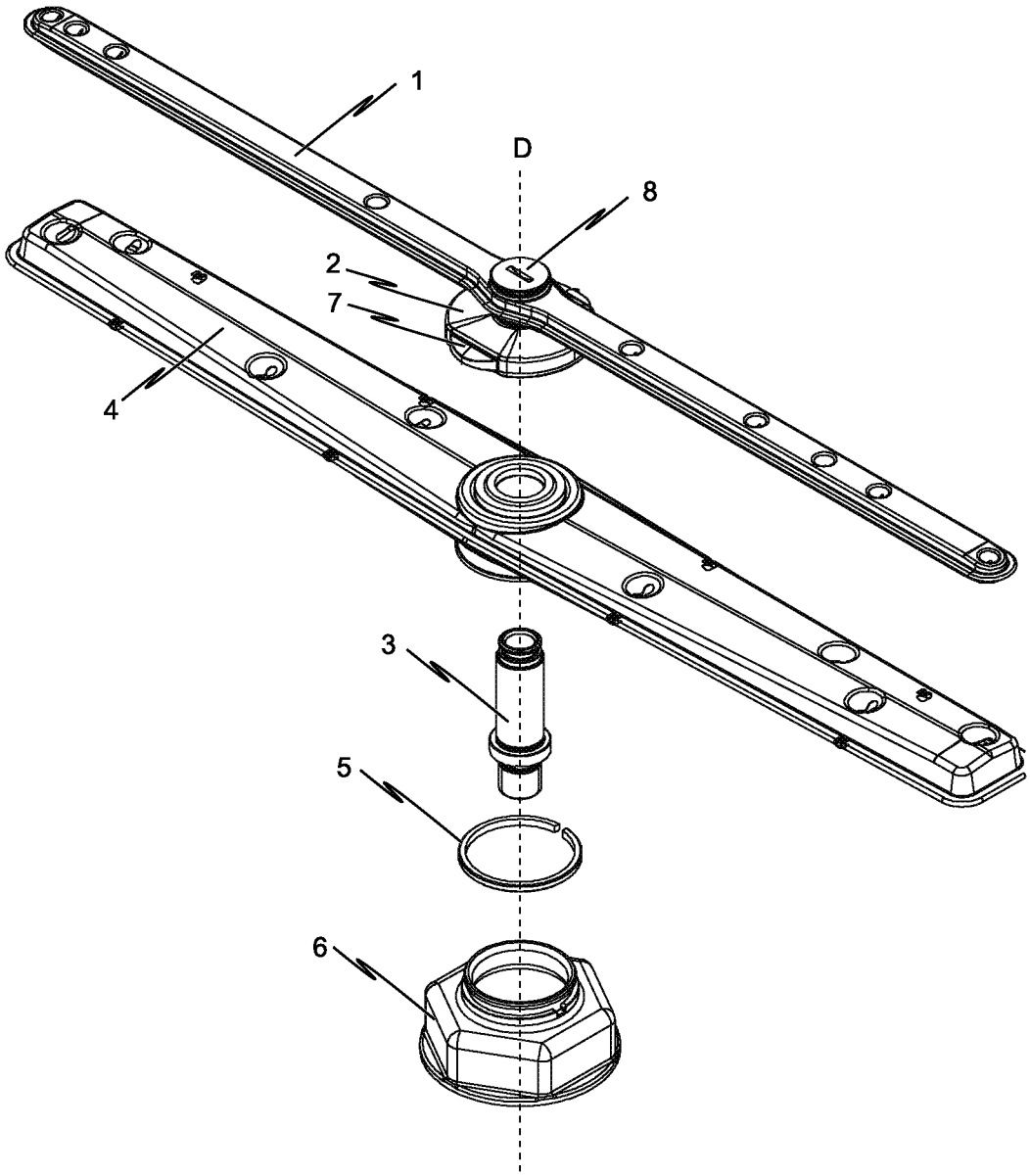
FIG. 1 shows a schematic perspective view of an illustrative embodiment of the rinse arm system according to the invention.
Figure 2:
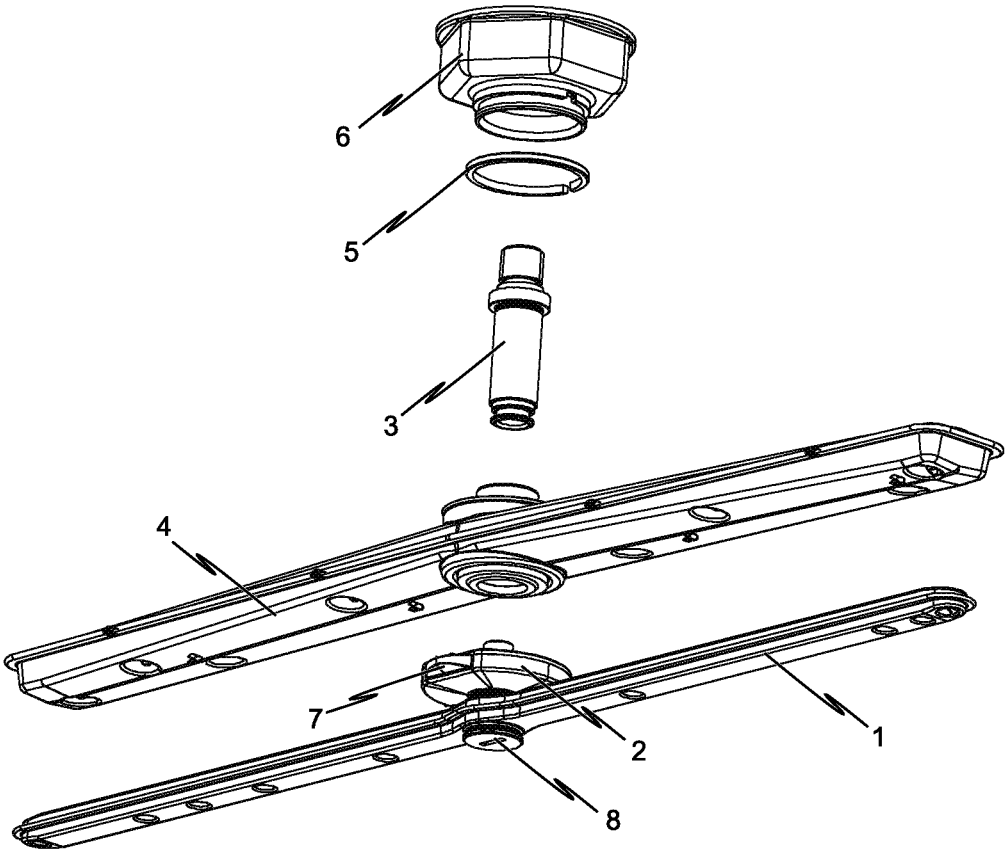
FIG. 2 shows a schematic perspective view of an illustrative embodiment of the rinse arm system according to the invention.
Figure 3:
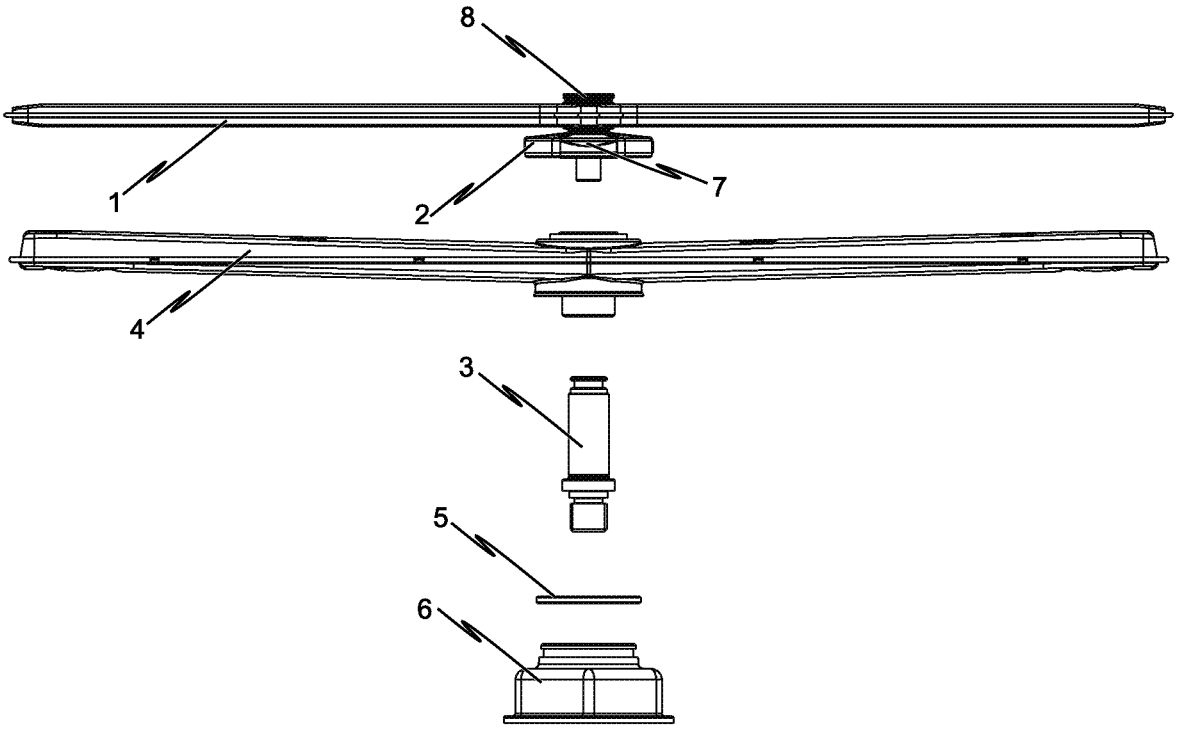
FIG. 3 shows a schematic side view of an illustrative embodiment of the rinse arm system according to the invention.
Figure 4:
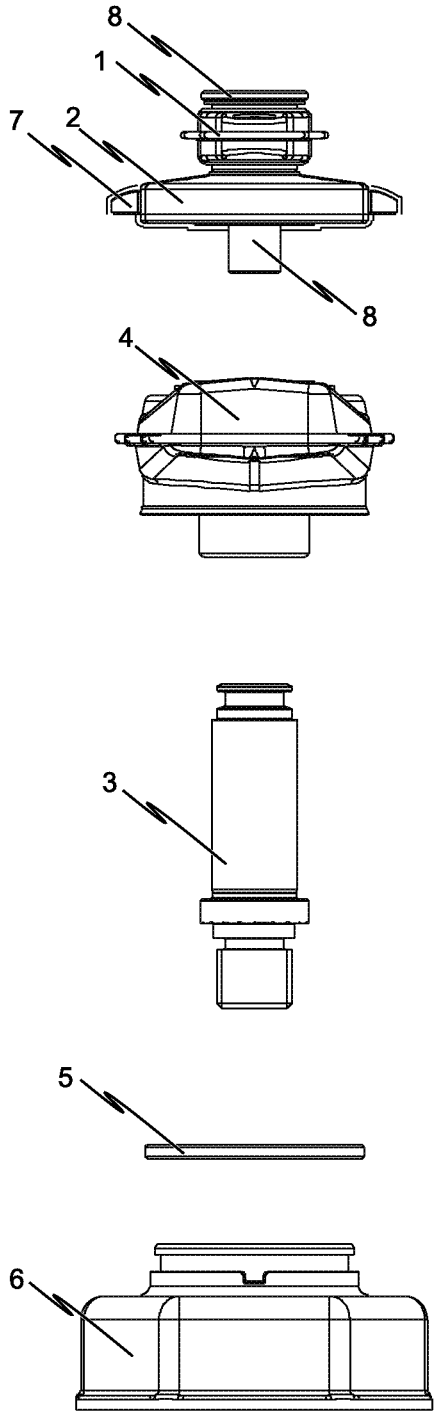
FIG. 4 shows a schematic side view of an illustrative embodiment of the rinse arm system according to the invention.

FIG. 1 is an exploded view of the entire rinse arm system, the upper area showing the rinse arm 1 connected to the locking mechanism 2. A more detailed description of this connection is given below with reference to FIGS. 6 and 7. Under the group composed of rinse arm 1 and locking mechanism 2, FIG. 1 shows a wash arm 4. The wash arm 4 can be pushed over a bushing 3 and fastened to a housing 6 by means of a clamping ring 5.

The housing 6 is arranged in the area of the interior of the treatment chamber of the warewasher. The housing 6 and therefore the entire rinse arm system can be arranged here in the upper, lower or lateral area of such a treatment chamber.

The wash arm 4 is connected to the housing 6 via the clamping ring 5 in such a way that the wash arm 4 is rotatable with respect to the housing 6, with respect to the rinse arm 1, with respect to the locking mechanism 2 and with respect to the bushing 3. The bushing 3 thus extends through the wash arm 4 toward the rinse arm 1 and toward the locking mechanism 2.

The bushing 3 can be fixedly connected to the locking mechanism 2, wherein the locking mechanism 2 can in this case preferably be engaged in an indentation area of the bushing 3. This indentation area is preferably a hexagonal indentation area in the end area of the bushing 3 directed toward the locking mechanism 2. However, the locking mechanism 2 can also be connected to the bushing 3 with a form-fit connection. In this case, no indentation area is provided in the bushing 3. The bushing 3 can in this case preferably be round. The force-fit connection is generated by a normal force being applied to the in-contact surfaces of the bushing 3 and of the locking mechanism 2, in such a way that a static friction is generated between the bushing 3 and the locking mechanism 2.

Figure 5:
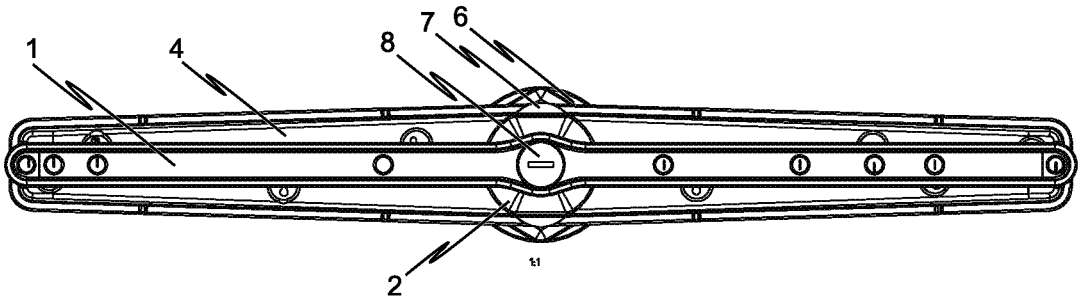
FIG. 5 shows a schematic plan view of an illustrative embodiment of the rinse arm system according to the invention.

FIG. 5 is a plan view of the assembled system composed of rinse arm 1, locking mechanism 2, wash arm 4, housing 6. The longitudinal axis of the rinse arm 1 advantageously extends so as to be congruent with the longitudinal axis of the wash arm 4, in order to ensure a space-saving assembly and to prevent wash liquid, which is sprayed from the wash arm 4, being diverted or deflected by the rinse arm 1, with the result that the wash liquid cannot be optimally distributed on the washware.

Figure 6:
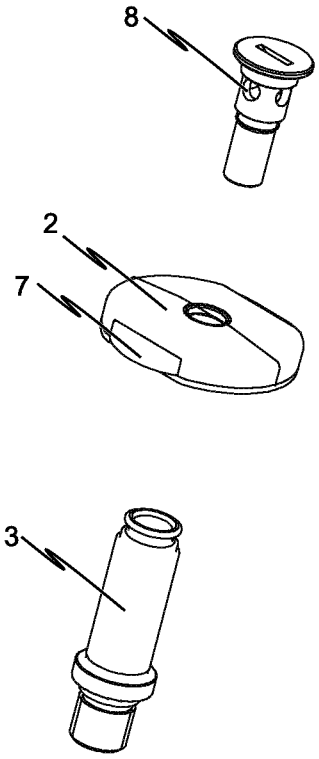
FIG. 6 shows a schematic perspective view of an illustrative embodiment of the locking mechanism together with the bushing.
Figure 7:
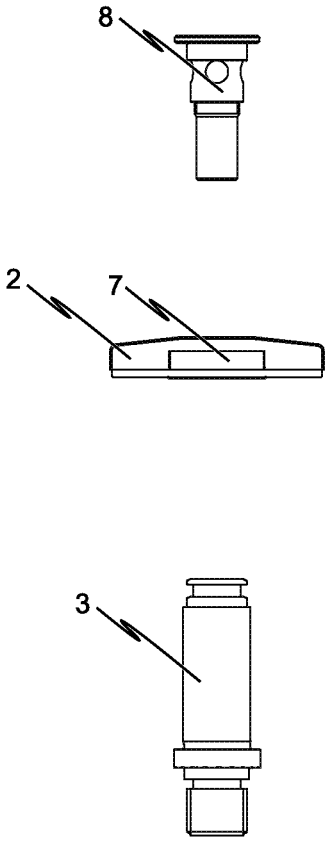
FIG. 7 shows a schematic side view of an illustrative embodiment of the locking mechanism together with the bushing.

FIGS. 6 and 7 show in detail the locking mechanism 2, and also a second bushing 8 via which the rinse arm 1 can be connected rotatably to the locking mechanism 2. The second bushing 8 is preferably designed in such a way that an upper area of the second bushing 8 can be fixedly connected to the rinse arm 1 and a lower part of the second bushing 8 protrudes from the combination of second bushing 8 and rinse arm 1, such that this lower part of the second bushing 8 can be pushed into the locking mechanism 2. The bushing 3 can then be connected to the locking mechanism 2 in such a way that a firm connection between the locking mechanism 2 and the bushing 3 arises and the second bushing 8, which is connected to the rinse arm 1, is rotatable with respect to the locking mechanism 2 and with respect to the rotation axis (D).

The bushing 8 preferably projects from the rinse arm 1 in such a way that, when this part of the bushing 8 is pushed into the locking mechanism 2, the bushing 8 at least partially projects from the locking mechanism 2 in the direction of the bushing 3 from the locking mechanism 2. When connecting the locking mechanism 2 to the bushing 3, the bushing 8 is preferably inserted as a guide into the bushing 3 in such a way that the rinse arm 1 is parallel to the wash arm 4.

The locking mechanism 2 can here be connected to the bushing 3 by the actuation of the lateral slides 7, wherein latching or clamping elements inside the locking mechanism 2 are actuated, by actuation of the slides 7, in such a way that the locking mechanism 2 can be pushed onto the bushing 3 and, when the slides 7 are released, the latching or clamping elements inside the locking mechanism 2 are brought into engagement with an end area of the bushing 3. This area is hexagonal, for example, in order to permit latching, or round, for example, in order to permit clamping.

The invention is not limited to the illustrative embodiments of the rinse arm system according to the invention that are shown in the drawings, and instead it may also be gathered by consideration of all the features disclosed herein.

LIST OF REFERENCE SIGNS

1 rinse arm
2 locking mechanism
3 bushing
4 wash arm
5 clamping ring
6 housing
7 slide
8 second bushing
D rotation axis

The invention claimed is:

1. A rinse arm system for a warewasher, wherein the system comprises the following:

a rinse arm (1) rotatable about a rotation axis (D), a locking mechanism (2) connected to the rinse arm (1) in such a way that the locking mechanism (2) is rotatable about the rotation axis (D) and is rotatable with respect to the rinse arm (1); and a bushing (3), wherein the locking mechanism (2) can be latched in an interlocking manner or clamped in a force-fitting manner to the bushing (3) in such a way that, in the latched or clamped state, the locking mechanism (2) is fixedly connected to the bushing (3) and the rinse arm (1) is rotatable about the rotation axis (D) and is rotatable with respect to the bushing (3);

wherein a second bushing (8) is fixedly connected to the rinse arm (1) so as to rotate with the rinse arm (1), wherein the second bushing (8) includes a projecting portion that projects out of the rinse arm (1) and that is connected to the locking mechanism (2) such that the second bushing (8) is rotatable with the rinse arm (1) with respect to the rotation axis (D) and is rotatable with respect to the locking mechanism (2), wherein the projecting portion of the second bushing (8) is inserted within the bushing (3) such that the second bushing (8), including the projecting portion, rotates relative to the bushing (3) when the rinse arm (1) rotates.

2. The rinse arm system as claimed in claim 1, wherein the system additionally comprises a wash arm (4) connected to the bushing (3) in such a way that, in the connected state, the wash arm (4) is rotatable about the rotation axis (D), and wherein the wash arm (4) is connected to a housing (6) by a clamping ring (5).

3. The rinse arm system as claimed in claim 2, wherein the locking mechanism (2) is arranged between the wash arm (4) and the rinse arm (1).

4. The rinse arm system as claimed in claim 3, wherein the rinse arm (1) is connected to the locking mechanism (2) in such a way that, in the connected state, the rinse arm (1) is rotatable in relation to the wash arm (4) and in relation to the locking mechanism (2).

5. The rinse arm system as claimed in claim 2, wherein a wash water line and/or rinse water line is provided for supplying wash liquid to the wash arm (4) and/or rinse liquid to the rinse arm (1).

6. The rinse arm system as claimed in claim 5, wherein the wash water line and/or rinse water line are/is arranged in the interior of the housing (6).

7. The rinse arm system as claimed in claim 6, wherein a region of the rinse water line runs through the interior of the bushing (3).

8. The rinse arm system as claimed in claim 1, wherein the locking mechanism (2) is latched or clamped to the bushing (3) and is connected to the rinse arm (1) in such a way that the locking mechanism (2) is removable from the bushing (3) together with the rinse arm (1) by operating slides (7) which are arranged on the locking mechanism (2).

9. A rinse arm system for a warewasher, the system comprising:

a rinse arm (1) rotatable about a rotation axis (D), a locking mechanism (2) connected to the rinse arm (1) such that the locking mechanism (2) is rotatable with respect to the rinse arm (1); and a bushing (3), wherein the locking mechanism (2) is latched in an interlocking manner to the bushing (3) or clamped in a force-fitting manner to the bushing (3) such that the locking mechanism (2) is fixedly connected to the bushing (3) and the rinse arm (1) is rotatable about the rotation axis (D) with respect to the bushing (3);

wherein a second bushing (8) is fixedly connected to the rinse arm (1) so as to rotate with the rinse arm (1), wherein the second bushing (8) includes a projecting portion that projects from rinse arm (1) and that is connected to the locking mechanism (2) such that the second bushing (8) is rotatable with the rinse arm (1) about the rotation axis (D) with respect to the locking mechanism (2), wherein the projecting portion of the second bushing (8) is inserted within the bushing (3) such that the second bushing (8), including the projecting portion, rotates relative to the bushing (3) when the rinse arm (1) rotates.

10. The rinse arm system as claimed in claim 9, wherein the system further comprises a wash arm (4) connected to the bushing (3) such that the wash arm (4) is rotatable about the rotation axis (D), and wherein the wash arm (4) is connected to a housing (6) by a clamping ring (5).

11. The rinse arm system as claimed in claim 10, wherein the locking mechanism (2) is arranged between the wash arm (4) and the rinse arm (1).

12. The rinse arm system as claimed in claim 11, wherein the rinse arm (1) is connected to the locking mechanism (2) such that the rinse arm (1) is rotatable in relation to the wash arm (4) and in relation to the locking mechanism (2).

13. The rinse arm system as claimed in claim 12, wherein the locking mechanism (2) is latched to the bushing (3) or clamped to the bushing (3) and is connected to the rinse arm (1) such that the locking mechanism (2) is removable from the bushing (3) together with the rinse arm (1) by operating slides (7) which are arranged on the locking mechanism (2).

* * * * *